United States Patent [19]

Campbell

[11] 4,217,321

[45] Aug. 12, 1980

[54] METHOD FOR MAKING BICOMPONENT POLYESTER YARNS AT HIGH SPINNING RATES

[75] Inventor: William L. Campbell, Cary, N.C.

[73] Assignee: Monsanto Company, Decatur, Ala.

[21] Appl. No.: 966,831

[22] Filed: Dec. 6, 1978

[51] Int. Cl.[2] ..... D01D 5/22; D02G 3/00

[52] U.S. Cl. ..... 264/168; 264/171; 264/210.8; 428/369; 428/370; 428/374

[58] Field of Search ..... 264/171, 168, 210 Z, 264/210.8; 428/374, 370, 369

[56] References Cited

U.S. PATENT DOCUMENTS

| | | | |
|---|---|---|---|
| 4,019,311 | 4/1977 | Schippers | 264/210 Z |
| 4,115,989 | 9/1978 | Spolnecki | 264/171 |
| 4,117,194 | 9/1978 | Baube et al. | 264/171 |

*Primary Examiner*—Jay H. Woo

*Attorney, Agent, or Firm*—Robert L. Broad, Jr.

[57] ABSTRACT

The method of making a polyethylene terephthalate/-polybutylene terephthalate bicomponent filament having improved bulking properties, wherein such a bicomponent filament is spun at a spinning speed in excess of about 3,600 meters per minute and is then passed through an isolated zone where the filament is cold drawn 5 to 100 percent prior to being wound onto a bobbin.

5 Claims, 2 Drawing Figures

METHOD FOR MAKING BICOMPONENT POLYESTER YARNS AT HIGH SPINNING RATES

BACKGROUND OF THE INVENTION a. Field of the Invention

This invention relates to methods for making bicomponent polyester filaments having improved bulk potential.

b. Description of the Prior Art

The primary purpose of producing a bicomponent filament is to provide a filament which, when properly treated, will be self-crimping to give added bulk to yarns made from the filament. It has been found that certain bicomponent polyester filaments spun at relatively slow speeds and oriented in a separate operation by drawing the filaments 4.5 to 5.5× over a heated draw pin will have reasonably good bulkiness when subjected to a boiling water treatment. However, this process is undesirable from an economic standpoint for the reasons that the production rate is relatively low, additional energy is required to heat the filament and a separate operation is usually required. It has been found that the increasing of spinning speeds in such an operation, in order to increase productivity, usually results in a reduced bulk potential in the finished yarn.

In the process of the present invention, significantly higher spinning speeds can be used to produce bi-component filaments having excellent bulk potential by drawing bicomponent filaments of polyethylene terephthalate and polybutylene terephthalate at about room temperature in a zone isolated from the spinning zone. Substantially higher spinning rates have been achieved and the filaments produced have good bulk potential.

SUMMARY OF THE INVENTION

The method of making a polyethylene terephthalate/polybutylene terephthalate bicomponent filament having improved bulking properties, wherein such a bicomponent filament is spun at a spinning speed in excess of about 3,600 meters per minute and is then passed through a zone where the filament is drawn 5 to 100 percent at about room temperature prior to being wound onto a bobbin.

DETAILED DESCRIPTION OF THE INVENTION

Figure 1:
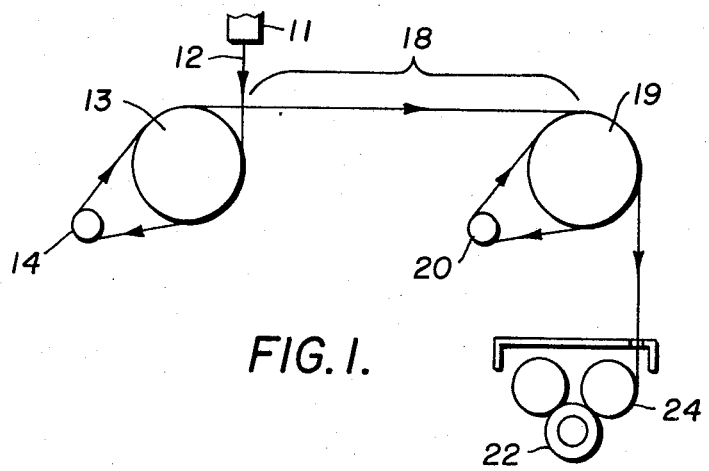
FIG. 1 of the drawing is a schematic view showing apparatus useful for carrying out the process of the present invention.

Referring now in detail to the drawing, FIG. 1 shows a schematic view of apparatus which may be used to carry out the process of the present invention. In this apparatus, a spinnerette 11 of a conventional type forms a bicomponent polyethylene terephthalate (PET)-/polybutylene terephthalate (PBT) filament 12. PBT is used with PET for the reason that PBT has a higher shrinkage, which enhances bulkiness in a bicomponent filament. Immediately below the spinnerette, the melt-spun filament is cooled by a stream of air before making several wraps around a feed or isolating roll 13 and an associated idler roll 14. The filament leaves the feed roll 13 and passes through a cold drawing zone 18 to a draw roll 19 associated with a second idler roll 20. After making several wraps around the draw roll 19 and the idler roll 20 the filament is wound onto a bobbin 22 driven by a drive roll 24, the bobbin 22 and the draw roll 19 having the same peripheral speed.

The rolls 13 and 19 are driven at such different speeds that the filament 12 is cold drawn 5 to 100 percent in the zone 18, the filament 12 being essentially at room temperature by the time it reaches the zone 18. The feed roll 13 serves to isolate tension applied to the filament 12 in the zone 18 from that portion of the filament between the spinnerette 11 and the feed roll 13. Only one filament is shown in the drawing, but it is understood that it is preferable that a bundle of several filaments be formed and drawn simultaneously. Preferably, the filament bundle will have a total denier of about 50 to 500.

Figure 2:
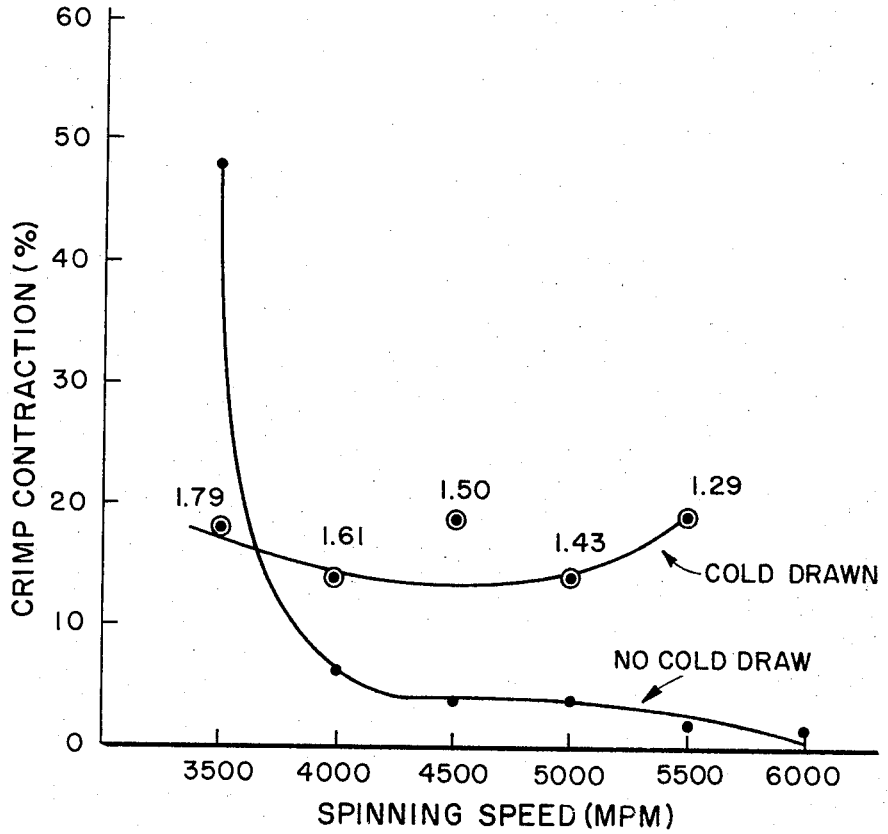
FIG. 2 is a graph showing a comparison of the bulk potential of the cold drawn yarn of the present invention and the bulk potential of a conventional yarn.

FIG. 2 shows a comparison, at various spinning speeds, between filaments cold drawn by the present process and filaments having no cold draw, the numbers on this graph showing draw ratios. Crimp contraction is the ordinate of this graph, crimp contraction being an indication of the bulking properties of the filaments. It will be seen from FIG. 2 that the crimp contraction values or bulking properties of fibers or yarns having no cold draw decreased drastically with increased spinning speed, ranging from good bulking properties at about 3,200 meters per minute to almost no bulking properties at spinning speeds above about 5,500 meters per minute.

The bulking potentials of the yarns were determined by using the following described crimp contraction tests, crimp contraction being a good indicator of bulking potential. A skein of yarn was prepared to have a denier of 8,000 and a skein length of 0.56 meters. The skein was suspended on a measuring board and loaded with a 2,000 gram weight and the original length, $L_O$, was measured. The skein was then shock-bulked in boiling water where it remained for five minutes. The skein was then centrifuged to remove excess water and dried in a forced air oven at 50° C. The skein was then suspended on the measuring board and again loaded with a 2,000 gram weight and the bulked length, $L_B$, of the boiled skein was measured after two minutes. The 2,000 gram weight was removed and a 16 gram weight attached to the skein. After one hour, the relaxed length, $L_R$, of the skein was measured. Crimp contraction was calculated as follows:

$$\% \text{ Crimp Contraction} = \frac{L_B - L_R}{L_B} \times 100$$

$$\% \text{ Skein Shrinkage} = \frac{L_O - L_B}{L_O} \times 100$$

EXAMPLE

PET polymer chips having an intrinsic viscosity of 0.70 (measured in 60/40 phenol/tetrachloroethane) were dried for 12 hours at 135° C. and at less than 0.5 mm Hg. pressure to a moisture level of less than about 0.01 weight percent. Likewise, PBT polymer chips having an intrinsic viscosity of 1.06 were dried to an equivalent moisture level by heating them for 18 hours at 105° C. and at less than 0.5 mm Hg. pressure. The PET and PBT chips were melted and spun under suitable conditions, using a conventional conjugate spinning unit, into 34 filament, side-by-side (50/50 weight ratio) bicomponent filaments or yarns. The filaments were extruded at a rate of 90 gms/min (45 gms/min each polymer) and wound onto packages at spinning speeds ranging from about 3,200 meters per minute (mpm) to about 5,000 mpm.

Between the spinnerette and the draw roll 19, the yarn is passed several times around the isolation or feed roll 13 and the idle roll 14 to prevent tension applied to the yarn in the cold draw zone 18 from extending into the zone between the spinnerette 11 and the feed roll 13. The feed roll 13 was driven at the same peripheral speed as the draw roll 19 for obtaining comparative examples and, in other runs, was driven at a somewhat slower speed than the draw roll 19 for applying a cold draw to the yarns in the cold draw zone. The peripheral speed of the draw roll 19 was varied to provide cold-draw stretch ratios ranging from 1.0 to 1.790 at various spinning speeds. Drawing the filament 5 to 100 percent is equivalent to draw ratios of 1.05 to 2. Table 1 shows the results obtained.

TABLE I

| Run No. | Speed Feed Roll (YPM) | Speed Feed Roll (MPM) | Speed Draw Roll (YPM) | Speed Draw Roll (MPM) | Draw Ratio | Bulk Properties: Skein Shrinkage (%) | Bulk Properties: Crimp Contraction (%) |
|---|---|---|---|---|---|---|---|
| 1* | 3500 | 3200 | 3500 | 3200 | 1.000 | 8 | 49 |
| 2 | 2331 | 2130 | 3500 | 3200 | 1.502 | 31 | 22 |
| 3 | 1955 | 1790 | 3500 | 3200 | 1.790 | 32 | 18 |
| 4* | 4000 | 3660 | 4000 | 3660 | 1.000 | 5 | 6 |
| 5 | 2666 | 2440 | 4000 | 3660 | 1.500 | 30 | 17 |
| 6 | 2478 | 2265 | 4000 | 3660 | 1.614 | 29 | 14 |
| 7* | 4500 | 4115 | 4500 | 4115 | 1.000 | 5 | 3 |
| 8 | 3000 | 2745 | 4500 | 4115 | 1.500 | 30 | 19 |
| 9 | 2647 | 2420 | 4500 | 4115 | 1.700 | 32 | 18 |
| 10 | 4900 | 4480 | 4900 | 4480 | 1.000 | 5 | 2 |
| 11* | 5000 | 4572 | 5000 | 4572 | 1.00 | 4 | 2 |
| 12 | 3497 | 3197 | 5000 | 4572 | 1.43 | 6 | 14 |
| 13* | 5500 | 5029 | 5500 | 5029 | 1.00 | 3 | 1 |
| 14 | 5000 | 4572 | 5500 | 5029 | 1.10 | 6 | 9 |
| 15 | 4264 | 3900 | 5500 | 5029 | 1.29 | 22 | 19 |

*Comparative runs. It will be noted that in the runs made for comparative purposes (Runs 1, 4, 7, 10, 11 and 13) the crimp contraction values fell off sharply as spinning speed was increased. Spinning speed is the feed roll speed.

By using the cold draw step of this invention it is possible to substantially increase productivity by operating at higher spinning speeds.

It will be noted from FIG. 2 that, at low spinning speeds, the crimp contraction of yarns having no cold draw was higher than that of yarns which had been cold drawn. However, as spinning speeds were increased, the crimp contraction of those yarns having no cold draw fell rapidly and, at higher spinning speeds, these yarns had less crimp contraction than those processed by the process of the present invention. Crimp contraction for yarns treated by the process of the present invention ranged from about 15 percent to about 20 percent at spinning speeds of about 3,500 MPM to about 6,000 MPM. Thus, by using the process of the present invention, spinning speeds can be increased substantially without losing crimp contraction.

What is claimed is:

1. The method of making a bicomponent polyester filament having improved bulking potential, comprising:

(a) spinning a bicomponent filament having polyethylene terephthalate as one component and polybutylene terephthalate as the other component, said spinning being carried out at a filament speed in excess of about 3,600 meters per minute, (b) passing the filament through an isolated zone, (c) cold drawing the filament 5 to 100 percent in the isolated zone, and (d) winding up the filament.

2. The method of claim 1 wherein the spinning speed is about 3,600 to 6,000 meters per minute and the cold drawn filament has a crimp contraction of about 15 to 20 percent.

3. The method of claim 1 wherein the amount of each of the two components making up the filament is about the same.

4. The method of claim 3 wherein the two components are in a side-by-side relationship.

5. The method of claim 4 wherein the filament is part of a filament bundle having a total denier within the range of 50 to 500.

* * * * *